US006769269B2

(12) United States Patent
Oh et al.

(10) Patent No.: US 6,769,269 B2
(45) Date of Patent: Aug. 3, 2004

(54) MULTISTAGE GAS AND LIQUID PHASE SEPARATION CONDENSER

(75) Inventors: Kwangheon Oh, Daejeon-si (KR); Sangok Lee, Daejeon-si (KR); Taeyoung Park, Daejeon-si (KR); Yongho Kim, Daejeon-si (KR)

(73) Assignee: Halla Climate Control Corporation, Daejeon-si (KR)

( * ) Notice: Subject to any disclaimer, the term of this patent is extended or adjusted under 35 U.S.C. 154(b) by 16 days.

(21) Appl. No.: 10/444,486

(22) Filed: May 23, 2003

(65) Prior Publication Data

US 2003/0217567 A1 Nov. 27, 2003

(30) Foreign Application Priority Data

May 24, 2002 (KR) ..... 10-2002-0028828

(51) Int. Cl.[7] ..... F25B 39/04
(52) U.S. Cl. ..... 62/507; 62/509
(58) Field of Search ..... 62/507, 509; 165/110, 165/144, 174, 176

(56) References Cited

U.S. PATENT DOCUMENTS 5,203,407 A * 4/1993 Nagasaka ..... 165/174
5,752,566 A * 5/1998 Liu et al. ..... 165/110
5,946,932 A * 9/1999 Wang ..... 62/305
5,988,267 A 11/1999 Park et al.
6,370,909 B2 * 4/2002 Watanabe et al. ..... 62/509

FOREIGN PATENT DOCUMENTS

JP 7103612 4/1995

* cited by examiner

*Primary Examiner*—Melvin Jones
(74) *Attorney, Agent, or Firm*—Fulbright & Jaworski L.L.P.

(57) ABSTRACT

The gas-liquid separating condenser of the present invention can enhance the sub-cooling rate in the pre-sub-cooling section as well as in the total sections. Moreover, the present invention can have designs according to calculated conditional expressions of relative dimensional ratios of the sections in condensation of refrigerant to realize the optimum condensing efficiency regardless of the overall size of the gas-liquid separating condenser.

10 Claims, 11 Drawing Sheets

MULTISTAGE GAS AND LIQUID PHASE SEPARATION CONDENSER

BACKGROUND OF THE INVENTION

1. Field of the Invention

The present invention relates to a multistage gas and liquid phase separation condenser for condensing and separating initially introduced gaseous refrigerant of high pressure into gas and liquid. In particular, after refrigerant is separated into gas and liquid, the multistage gas and liquid phase separation condenser of the invention can improve the sub-cooling rate of liquid refrigerant while it flows through a pre-sub-cooling section and additionally in other sections.

2. Background of the Related Art

A condenser liquefies refrigerant of high temperature and pressure fed from a compressor via heat exchange between refrigerant and ambient air. A receiver tank or section is arranged between the condenser and an expansion valve and temporarily stores liquefied refrigerant from the condenser so that liquid refrigerant can be fed into an evaporator according to a desired amount of cooling load.

Recently, condensers each having a receiver tank integrally attached thereto are widely commercialized in order to maximize space utilization in an engine room of a vehicle.

Of the condensers each having an integral receiver tank, it is developed a multistage gas and liquid phase separation condenser which comprises a pair of headers and a receiver tank provided in one of the headers.

U.S. Pat. No. 5,203,407 discloses a conventional multistage gas and liquid phase separation condenser or heat exchanger.

As shown in FIG. 6, the conventional heat exchanger 1 comprises a plurality of flat tubes 2 and corrugated fins 3, which are mounted on a pair of header tanks 4 opposed to each other.

Each header 4 comprises blind caps 5 at opposite ends, three baffles or partitions 6 and 6' and four compartments 8*a*.

The header tank 4 on the inlet side is provided with a tank member or separate member 7 which defines on the outer side of this header tank 4, an inlet pipe 9 is connected to the tank member 7, and a distributing chamber 8 is in communication with the a pair of refrigerant passages 2A and 2B through respective communication ports 10*a*, 10*b* provided in the header tank 4.

The header 4 has a separate member 11 formed outside, and a refrigerant collecting chamber 12 is connected with a pair of refrigerant passages 2A and 2B via ports 13*a* and 13*b* in the header 4.

In this heat exchanger 1, after introduced into the distributing chamber 8 via the inlet pipe 8, refrigerant partially flows into the upper refrigerant passage 2A via the communication port 10*a* and partially feeds into the lower refrigerant passage 2B via the communication port 10*b*.

Then, a partial refrigerant flow through the upper refrigerant passage 2A is introduced into the collecting chamber 12 via the port 13*a*, and another partial refrigerant flow through the lower refrigerant passage 2B is introduced via the port 13*b* into the collecting chamber 12, where refrigerant exits via an outlet pipe 14 to the outside.

The conventional heat exchanger distributes refrigerant to the upper and lower passages and thus remarkably reduces refrigerant pneumatic resistance within the respective header tanks.

However, the conventional heat exchanger does not effectively separate refrigerant into liquid and gas. In addition, because the separate member 7 and collecting chamber 12 functioning as a receiver tank are provided respectively to the header tanks 4, the heat exchanger has a relatively large size.

In the meantime, a Japanese Laid-Open Patent Publication Serial No. 7-103612 discloses a condenser which is integrally provided with a receiver tank at one end of header tanks in order to reduce the overall size.

As shown in FIG. 7, the condenser 3 having the integral receiver tank comprises a condensation section 8, a receiver section 9 and a sub-cooling section 10, in which the condensation section 8 is connected to the outlet side of a compressor 2.

The condensation section 8 introduces liquid-gas refrigerant into the receiver section 9, which separates refrigerant into gaseous and liquid refrigerant and feeds liquid refrigerant into the sub-cooling section 10.

The sub-cooling section 10 is arranged under and adjacent the condensation section 8, and sub-cools liquid refrigerant introduced from the receiver section 9.

The condenser 3 is provided with a second header 16 having an upstream side connected with a lower end of the condensation section 8 and a lower side connected with an upstream end of the sub-cooling section 10. The second header 16 is divided by first and second baffles 41 and 42 into an upstream communication chamber 46, a downstream communication chamber 47 and the receiver section 9.

As a result, two phase refrigerant of gas-liquid flown out via the condensation section 8 is introduced into the receiver section 9 via the upstream communication chamber 46.

The first baffle 41 vertically arranged within the second header 16 is provided with a refrigerant inlet port 44 communicating with an upper end of the receiver section 9 and a refrigerant outlet port 45 opened to a lower end of the receiver section 9 so that refrigerant can enter the entire receiver section 9.

In FIG. 7, some of reference numbers which do not designate the above-described components are not explained.

As set forth above, the conventional condenser installs the receiver section in one of the header tanks to reduce the overall size thereof, allows whole refrigerant to flow into the receiver section 9 to improve responsiveness in respect to rapid load fluctuation in a cooling cycle 1, and installs the sub-cooling section 10 to completely remove bubbly gaseous refrigerant.

The conventional condenser includes the receiver section to realize effective sub-cooling. However, there is a drawback that the sub-cooling rate cannot be further raised at a point where liquid refrigerant returns and initially sub-cools after gaseous refrigerant of high temperature and pressure is initially introduced and condensed into gas and liquid.

Furthermore, the conventional condenser further comprises a site glass 4 for confirming whether or not refrigerant finely condenses, and thus fabrication cost disadvantageously increases.

SUMMARY OF THE INVENTION

The present invention has been made to solve the foregoing problems and it is therefore an object of the present invention to provide a multistage gas and liquid phase separation condenser for condensing and separating initially introduced gaseous refrigerant of high pressure into gas and liquid, by which after separated into gas and liquid, liquid refrigerant can be improved with sub-cooling rate while flowing through a pre-sub-cooling section and additionally in other sections.

Also, the invention has a multistage gas and liquid phase separation condenser designed according to a conditional expression, which follows the relative dimension ratio of sections during condensation of refrigerant, in order to realize optimum condensation efficiency regardless of the total size of the condenser.

According to an aspect of the invention, there is provided a multistage gas and liquid phase separation condenser comprising: an super heat cooling/condensing section dm1 for cooling gaseous refrigerant of high temperature and pressure, which is introduced into the section dm1, to remove excessive heat therefrom and condense gaseous refrigerant; a first condensing section dm2 placed over the super heat cooling/condensing section dm1 for recondensing gaseous refrigerant; a second condensing section dm3 placed over the first condensing section dm2 for recondensing refrigerant to a liquid ratio higher than in the first condensing section dm2, whereby refrigerant is introduced into a receiver section 400 after flowing through the second condensing section dm3; a first sub-cooling section dm4 placed downstream of the super heat cooling/condensing section dm1 for sub-cooling refrigerant more than in the super heat cooling/condensing section dm1, whereby refrigerant is introduced into the receiver section 400 after flowing through the first sub-cooling section dm4 to join liquid refrigerant from the second condensing section dm3; and a second sub-cooling section dm5 placed downstream of the first sub-cooling section dm4 for sub-cooling liquid refrigerant joined from the second condensing section dm3 and the first sub-cooling section dm4 and for discharging sub-cooled liquid refrigerant therefrom, wherein the sections dm1, dm2, dm3, dm4 and dm5 are divided from one another.

DETAILED DESCRIPTION OF THE PREFERRED EMBODIMENT

The following detailed description will present a preferred embodiment of the invention in reference to the accompanying drawings.

Figure 1:
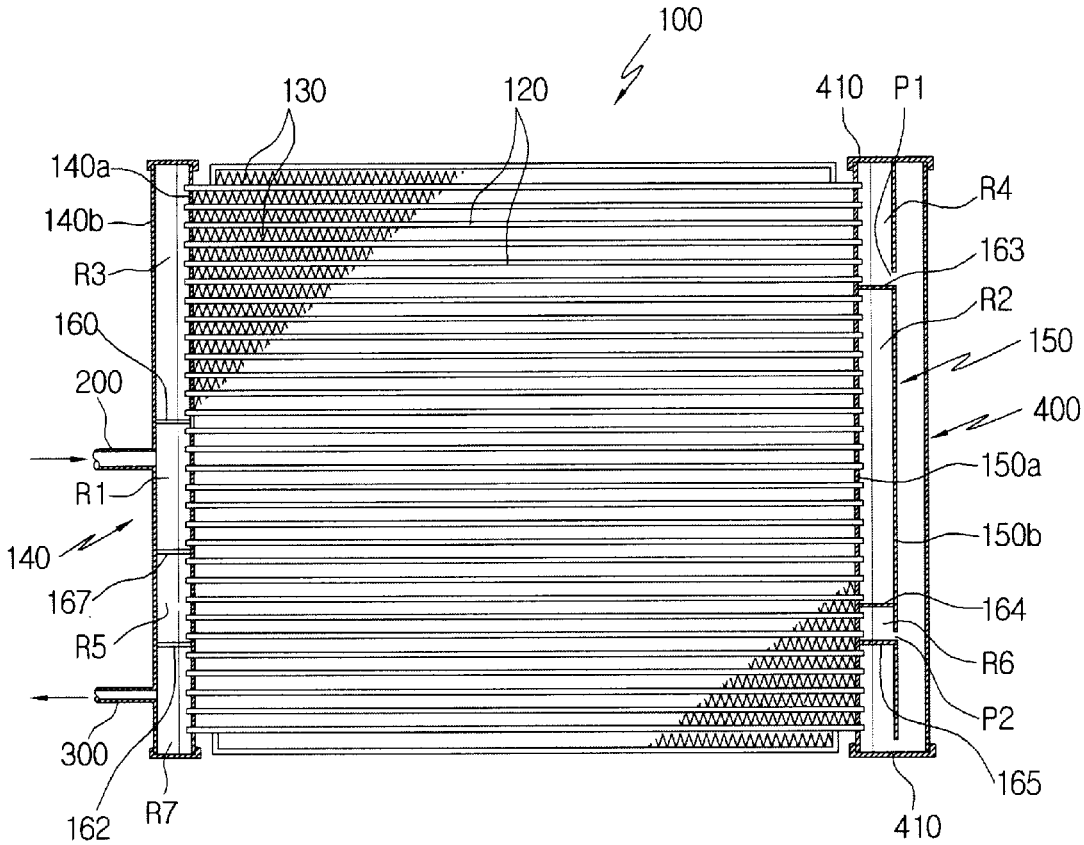
FIG. 1 illustrates a multistage gas and liquid phase separation condenser of the invention.
Figure 2:
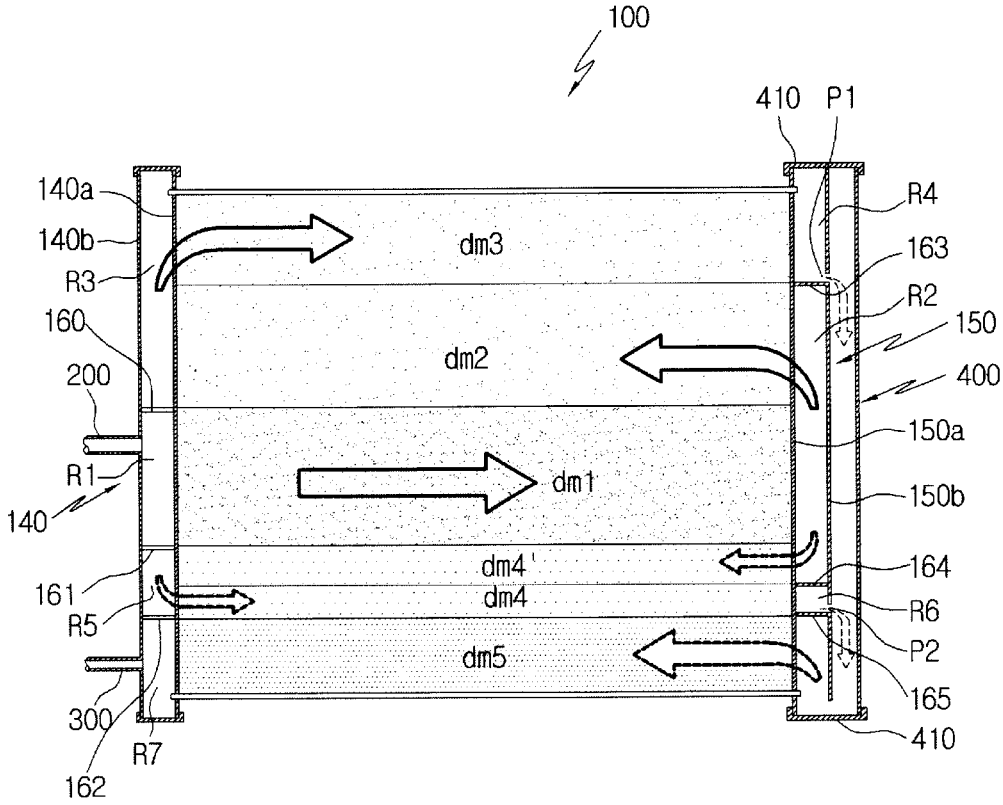
FIG. 2 illustrates flow of refrigerant in the multistage gas and liquid phase separation condenser shown in FIG. 1.

FIG. 1 is a sectional view illustrating a multistage gas and liquid phase separation condenser of the invention, and FIG. 2 illustrates flow of refrigerant in the multistage gas and liquid phase separation condenser shown in FIG. 1.

In the condenser 100 of the invention, a core section includes a plurality of tubes 120, which are stacked together one on another, and radiating fins each arranged between two adjacent tubes 120. First and second header tanks 140 and 150 are arranged at both ends of the tubes 120, and opposed to each other in a longitudinal direction.

The first header tank 140 is constituted by combination of a header 140*a* and a tank 140*b* to form a refrigerant passage of an overall elliptic configuration, and the second header tank 150 is constituted by combination of a header 150*a* and a tank 150*b* to form a refrigerant passage of an overall elliptic configuration.

The first header tank 140 is divided by a plurality of baffles 160, 161 and 162 into a plurality of fluid passages, and the second header tank 150 is also divided by a plurality of baffles 163, 164 and 165 into a plurality of fluid passages.

The first header tank 140 is provided with an inlet pipe 200 for introducing gaseous refrigerant of high temperature and pressure into the first header tank 140 and an outlet pipe 300 for discharging liquid refrigerant which transformed phase from gaseous refrigerant via heat exchange with the ambient air.

The inlet pipe 200 is placed between the first and second baffles 160 and 161 dividing the inside of the first header tank 140, and the outlet pipe 300 is placed under the third baffle 162.

The section between the first and second baffles 160 and 161 formed in the first header tank 140 defines an super heat cooling/condensing section dm1 where gaseous refrigerant introduced through the inlet pipe 200 is cooled to lose overheat and condensed.

The fourth to sixth baffles 163 to 165 in the second header tank 150 are arranged at positions different from those of the first to third baffles 160 to 162 in the first header tank 140 so as to form multistage refrigerant passages.

That is, the fourth baffle 163 in the second header tank 150 is placed higher than the first baffle 160 in the first header tank 140, and the fifth baffle 164 in the second header tank 150 is placed lower than the second baffle 161 and higher than the third baffle 162 in the first header tank 140.

The sixth baffle 165 is placed on the same horizontal level as the third baffle 162 so that phase-transformed refrigerant can flow to the outlet pipe 300 via a receiver section 400 which will be described hereinafter.

A vertical section between the first baffle 160 and the fourth baffle 163 defines a first condensing section dm2 placed above the super heat cooling/condensing section dm1.

A vertical section between the fourth baffle 163 and the uppermost one of the tubes 120 defines a second condensing section dm3 placed above the first condensing section dm2. Gaseous refrigerant re-condenses in the second condensing section dm3, and after flowing through this section dm3, refrigerant exits to the receiver section 400.

A vertical section between the fifth baffle 164 and the sixth baffle 165 defines a first sub-cooling section dm4 placed downstream of the super heat cooling/condensing section dm1. The first sub-cooling section dm4 sub-cools refrigerant more than in the super heat cooling/condensing section dm1. After flowing through the first sub-cooling section dm4, refrigerant is guided by the first sub-cooling section dm4 to exit into the receiver section 400, where refrigerant from the first sub-cooling section dm4 joins refrigerant from the second condensing section dm3.

A vertical section between the sixth baffle 165 and the lowermost one of the tubes 120 defines a second sub-cooling section dm5 placed downstream of the first sub-cooling section dm3. The second sub-cooling section dm5 sub-cools liquid refrigerant joined from the second condensing section dm3 and the first sub-cooling section dm4, and then discharges sub-cooled liquid refrigerant to the outside.

Further, a pre-sub-cooling section dm4' exists between the super heat cooling/condensing section dm1 and the second sub-cooling section dm5 for sub-cooling liquid refrigerant.

The pre-sub-cooling section dm4' is designed so that the passage area $A_{dm4'}$ thereof for sub-cooling liquid refrigerant is in a range of about 0.02 to 0.15 in respect to the total heat transfer area $A_{TOTAL}$ of the condenser.

In addition, the pre-sub-cooling section dm4' is designed so that the ratio $A_{dm4'}/A_{dm5}$ of the passage area $A_{dm4'}$ of the pre-sub-cooling section dm4' to the passage area $A_{dm5}$ of the second sub-cooling section dm5 is in a range of about 0.1 to 0.6.

Figure 5A:
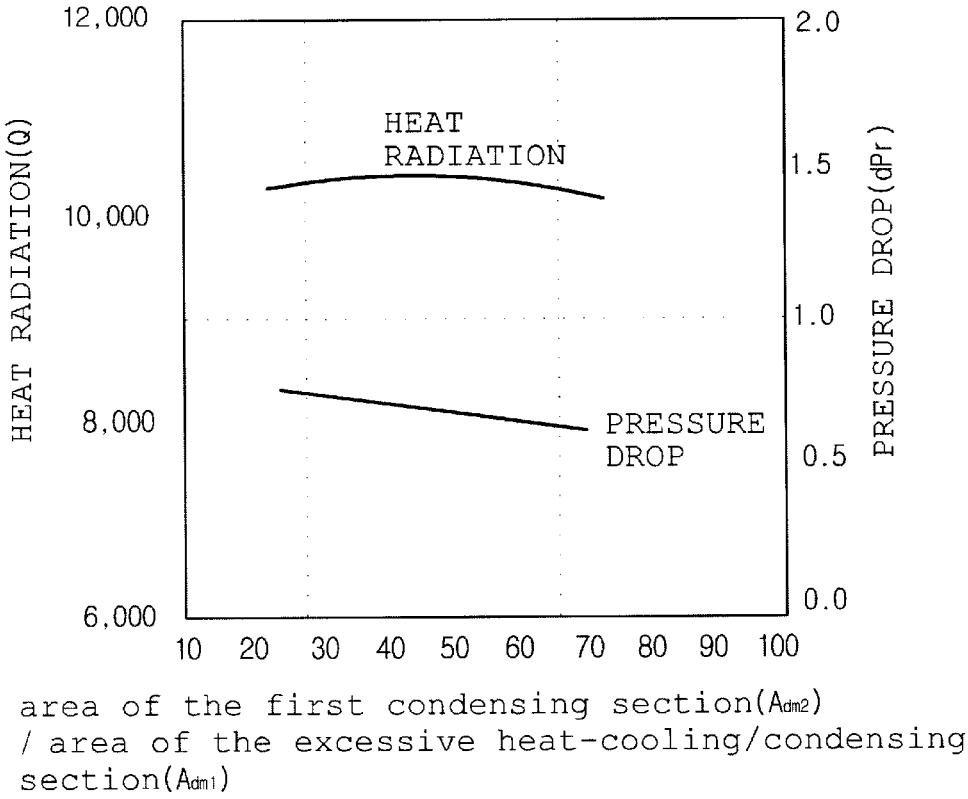
FIG. 5A is a graph of heat radiation and pressure drop of refrigerant according to area ratio between a gaseous section in a first condensing section and an super heat cooling/condensing section.
Figure 5B:
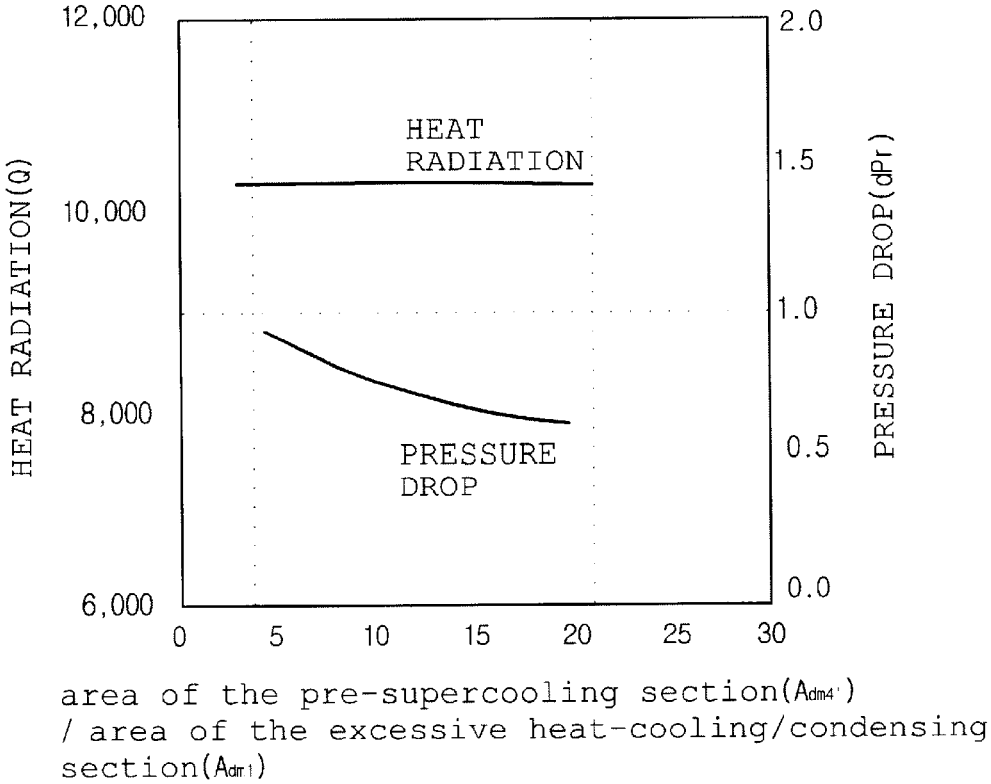
FIG. 5B is a graph of heat radiation and pressure drop of refrigerant according to area ratio between a liquid section in a pre-sub-cooling section and an super heat cooling/condensing section.
Figure 5C:
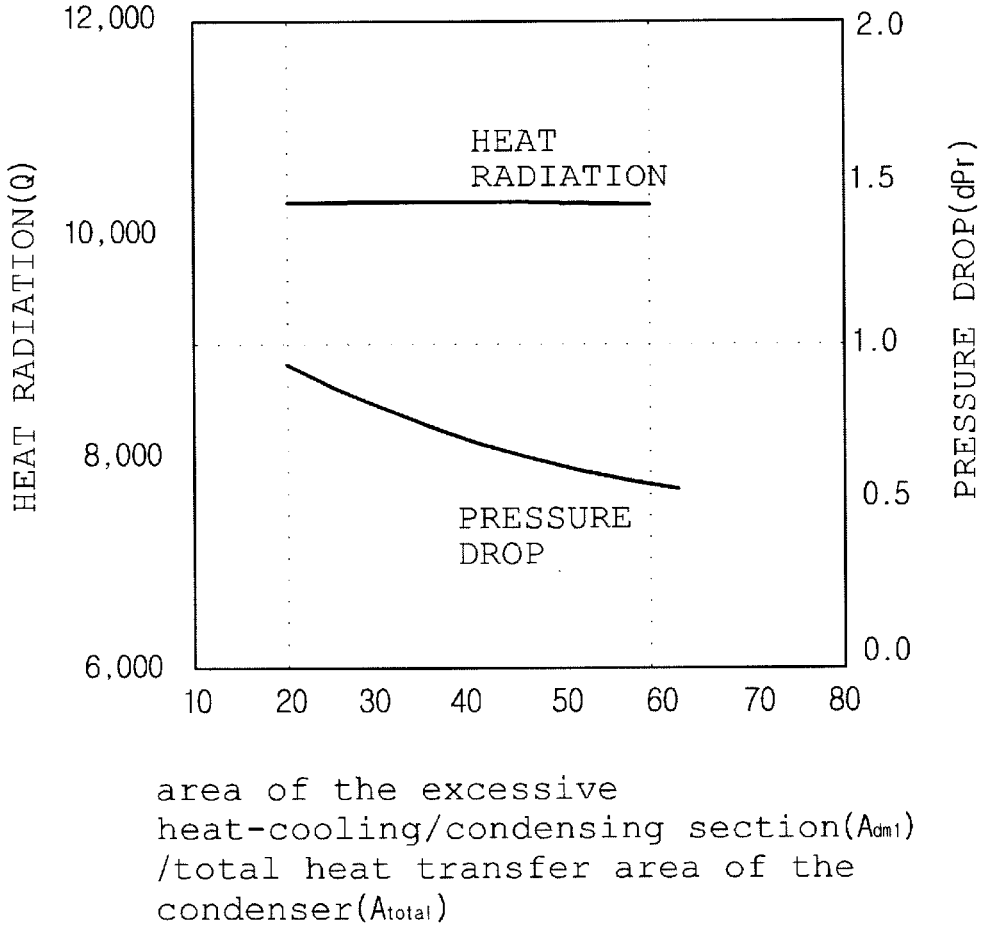
FIG. 5C is a graph of heat radiation and pressure drop of refrigerant according to area ratio between an super heat cooling/condensing section and the total heat transfer area.
Figure 5D:
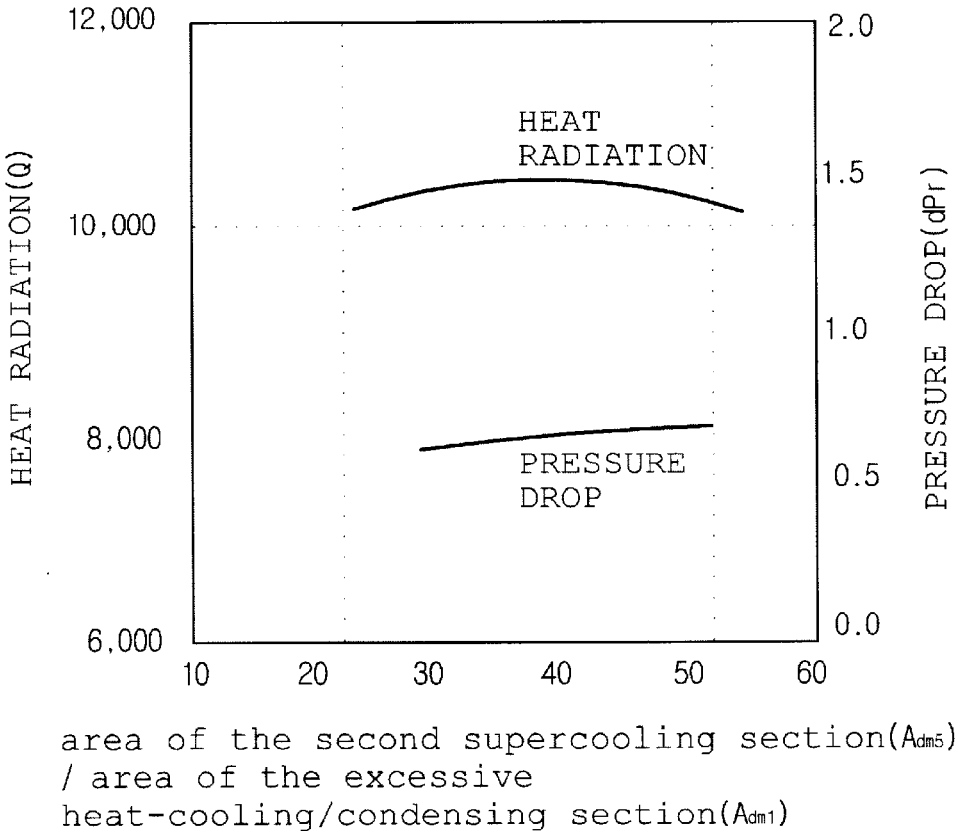
FIG. 5D is a graph of heat radiation and pressure drop of refrigerant according to area ratio between an super heat cooling/condensing section and a second sub-cooling section.
Figure 5E:
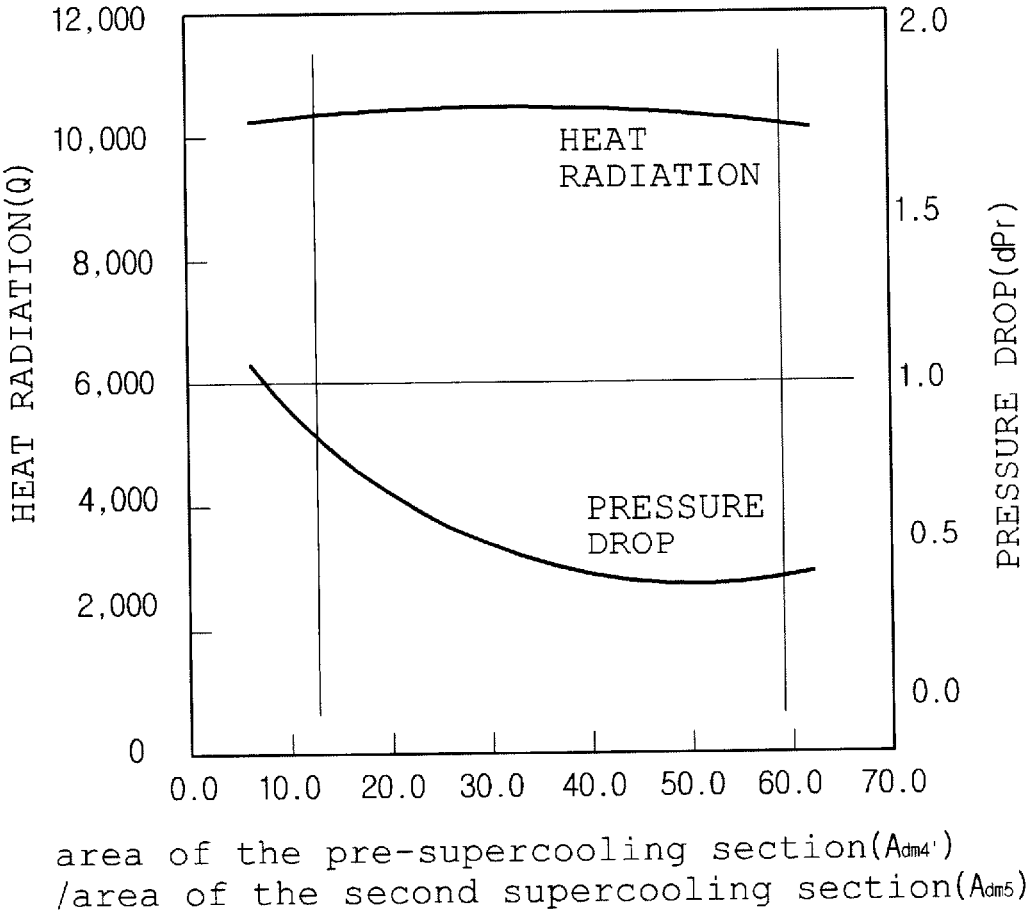
FIG. 5E is a graph of heat radiation and pressure drop of refrigerant according to area ratio between a pre-sub-cooling section and a second sub-cooling section.
Figure 6:
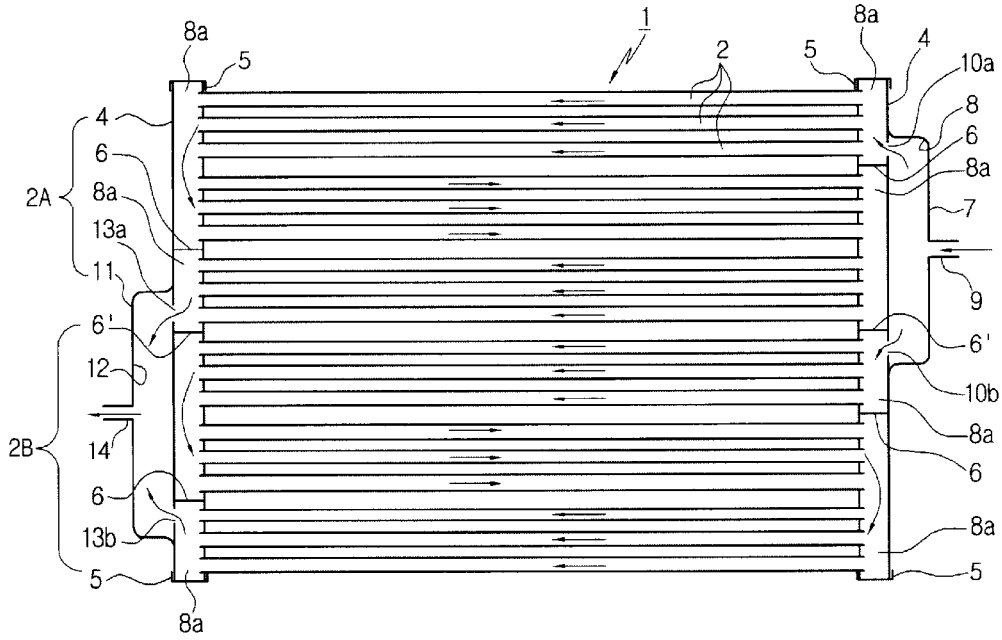
FIGS. 6 and 7 illustrate conventional condensers.
Figure 7:
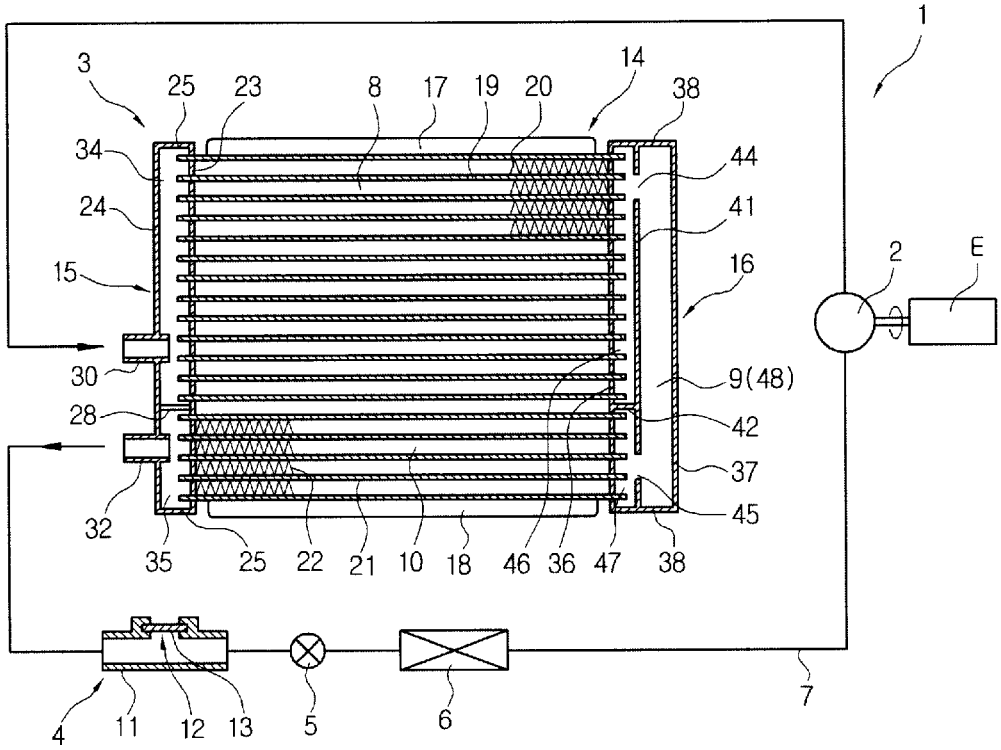

As shown in FIG. 5E, in the ratio of abut 3 to 59%, it can be observed that pressure drop is reduced while heat radiation maintain a substantially uniform value.

Alternatively, holes (not shown) can be formed in the above baffles to omit the pre-sub-cooling section dm4'.

Also, the receiver section 400 is provided with a passage P1 to communicate with the tank 150*b* of the second header tank 150.

Blind caps 410 are provided in both ends of the first and second tanks 140 and 150 of the condenser 100 to seal the tanks 140 and 150 preventing leak of refrigerant.

The invention of the above construction is designed to satisfy a conditional expression of $A_{dm1}>A_{dm2}\geqq A_{dm3}$ and $A_{dm4}\leqq A_{dm5}$, wherein $A_{dm1}$ indicates thee area of the super heat cooling/condensing section dm1, $A_{dm2}$ indicates the area of the first condensing section dm2, $A_{dm3}$ indicates the area of the second condensing section dm3, $A_{dm4}$ indicates the area of the first sub-cooling section dm4, and $A_{dm5}$ indicates the area of the second sub-cooling section dm5.

The invention can be further designed from the above basic construction so that the ratio $A_{dm2}/A_{dm1}$ of the area $A_{dm2}$ of the first condensing section dm2 to the area $A_{dm1}$ of the super heat cooling/condensing section dm1 is in a range of about 0.20 to 0.65.

The invention can be further designed from the above basic construction so that the ratio $A_{dm4'}/A_{dm1}$ of the area $A_{dm4'}$ of the pre-sub-cooling section dm4' to the area $A_{dm1}$ of the super heat cooling/condensing section dm1 is in a range of about 0.04 to 0.22.

The invention can be further designed from the above basic construction so that the ratio $A_{dm1}/A_{TOTAL}$ of the area $A_{dm1}$ of the super heat cooling/condensing section dm1 to the total heat transfer area $A_{TOTAL}$ of the condenser is in a range of about 0.20 to 0.60.

Also, the invention can be further designed from the above basic construction so that the ratio $A_{dm5}/A_{dm1}$ of the area $A_{dm5}$ of the second sub-cooling section dm5 to the area $A_{dm1}$ of the super heat cooling/condensing section dm1 has a threshold value in a range of about 0.20 to 0.55.

Hereinbefore description has presented conditional expressions that define the configuration of the condenser according to the ratio of the section areas occurring during a condensing process.

The following detailed description will present operations of the condenser constructions of the invention according to the above threshold values.

FIG. 2 illustrates flow of refrigerant in the multistage gas and liquid phase separation condenser of the invention, in which gaseous refrigerant of high temperature and pressure is introduced via the inlet pipe 120 from a compressor. Introduced gaseous refrigerant is cooled and loses excessive heat while flowing through some of the tubes 120 between the first and second baffles 160 and 161 after flowing through a compartment R1 in the first header tank 140, defined by the first baffle 160 and the second baffle 161.

That is, the vertical section between the first and second baffles 160 and 161 functions as the super heat cooling/condensing section dm1.

Gaseous refrigerant exchanges heat with the ambient air, and after flowing through the super heat cooling/condensing section dm1, is partially transformed into liquid and partially remains as gas so that refrigerant contains two phases of gas and liquid mixed therein.

In mixed refrigerant, relatively active gaseous refrigerant moves upward owing to buoyancy based upon density difference between gaseous refrigerant and liquid refrigerant. Liquid refrigerant moves downward along the gravity direction based upon high viscosity and mass and density larger than those of gaseous refrigerant.

Therefore, after passing through a compartment R2 in the second header tank 150 defined by the fourth and fifth baffles 163 and 164, gaseous refrigerant re-condenses while flowing through some of the tubes 120 between the first and fourth baffles 160 and 163.

That is, the vertical section between the first and fourth baffles 160 and 163 corresponds to the first condensing section dm2.

Preferably, the condenser can be designed so that the ratio $A_{dm1}/A_{dm2}$ of the passage area $A_{dm1}$ of the super heat cooling/condensing section dm1 to the passage area $A_{dm2}$ of the first condensing section dm2 is in a range of 0.2 to 0.65. Then, in the super heat cooling/condensing section dm1, more gaseous refrigerant can be condensed into liquid.

More particularly, as shown in FIG. 5A, the condenser shows a suitable amount of heat radiation where the ratio $A_{dm2}/A_{dm1}$ of the area of the first condensing section dm2 to the area of the super heat cooling/condensing section dm1 is in a range of about 25 to 65%. Most preferably, the ratio $A_{dm2}/A_{dm1}$ is about 30 to 40% at $0.20\leqq A_{dm2}/A_{dm1}\leqq 0.65$.

While the area of a gaseous section can be varied according to the temperature of air and wind velocity, it can be selected in a range that heat radiation may not decrease by a large value even though the area ration $A_{dm1}/A_{dm2}$ is within 30% or 70% or more.

After condensed in the first condensing section dm2 between the first and fourth baffles 160 and 163, gaseous refrigerant passes through a compartment R3 in the first header tank 140 defined by the first baffle 160. Then, while flowing through some of the tubes 120 corresponding to the vertical section from the fourth baffle 163 and the uppermost tube 120, gaseous refrigerant re-condenses to a liquid ratio higher than that of refrigerant in the first condensing section dm2.

That is, the vertical section between the fourth baffle 163 and the uppermost tube 120 defines the second condensing section dm3.

Then, after being condensed and gradually liquefied in the second condensing section dm3, refrigerant flows through the passage P1 in a compartment R4 in the second header tank 164 defined by the fourth baffle 163 into the receiver section 400, where refrigerant drops downward.

Hereinbefore it has been described about behavior of gaseous refrigerant which passed through the super heat cooling/condensing section dm1.

The following description will represent a flowing process of refrigerant which transformed phase into liquid while passing through the super heat cooling/condensing section dm1.

After phase transformation into liquid while passing through the super heat cooling/condensing section dm1, liquid refrigerant flows through the compartment R2 in the second header tank 150 defined by the fourth and fifth baffles 163 and 164. Then, liquid refrigerant is sub-cooled while flowing through some of the tubes between the second and fifth baffles 161 and 164.

That is, the vertical section between the second and fifth baffles 161 and 164 corresponds to the pre-sub-cooling section dm4'.

Preferably, the invention designs the pre-sub-cooling section dm4' so that the passage area $A_{dm4'}$ thereof for sub-cooling liquid refrigerant is in a range of about 0.02 to 0.15 in respect to the total heat transfer area $A_{TOTAL}$ of the condenser.

Figure 3:
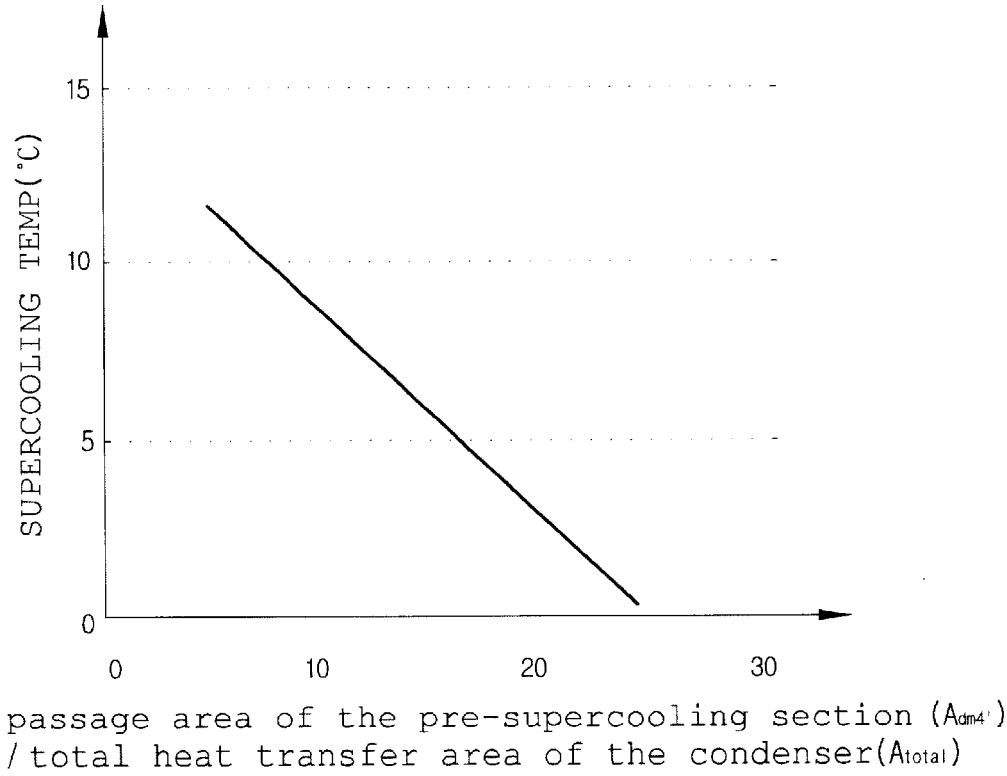
FIG. 3 is a graph of sub-cooling temperature variation according to the ratio of a pre-sub-cooling area.

FIG. 3 shows experimental data for ensuring the reliability of the above conditional expression.

As shown in FIG. 3, the sub-cooling temperature declines inversely proportional to the ratio $A_{dm4'}/A_{TOTAL}$ of the passage area of the pre-sub-cooling section dm4' to the total heat transfer area of the condenser. It can be seen that the ratio $A_{dm4'}/A_{TOTAL}$ is suitable in a range of about 3 to 20%.

On the contrary, if the pre-sub-cooling section increases up to or over 20% of the total heat transfer area, this section affects other sections to potentially deteriorate the performance of the condenser.

In addition, where the ratio $A_{dm4'}/A_{dm1}$ of the area $A_{dm4'}$ of the pre-sub-cooling section dm4' to the area $A_{dm1}$ of the super heat cooling/condensing section dm1 is in a range of about 0.04 to 0.22, the condenser of the invention can improve sub-cooling rate of liquid refrigerant.

As shown in FIG. 5B, where the ratio $A_{dm4'}/A_{dm1}$ of the area of the pre-sub-cooling section dm4' to the area of the super heat cooling/condensing section dm1 is in a range of about 4 to 22%, pressure drop declines while heat radiation remains substantially constant as the ratio $A_{dm4'}/A_{dm1}$ increases.

After sub-cooled in the pre-sub-cooling section dm4, refrigerant remains temporarily in a compartment R5 in the first header 4 defined by the second and third baffles 161 and 162. Then, refrigerant passes through some of the tubes 120 arranged between the fifth and sixth baffles 164 and 165, where it sub-cools more than in the pre-sub-cooling section dm4'.

The fifth and sixth baffles 164 and 165 form a compartment R6 in the second header tank 150 and a passage P2 is formed in the compartment R6 so that refrigerant which is further sub-cooled through the tubes 120 between the fifth and sixth baffles 164 and 165 exits via the passage P2 into the receiver section 400.

That is, the vertical section between the fifth and sixth baffles 164 and 165 corresponds to the first sub-cooling section dm4.

In the receiver section 400, liquid refrigerant condensed through the second condensing section dm3 joins liquid refrigerant condensed through the first sub-cooling section dm4. Liquid refrigerant in the receiver section 400 flows through lowermost tubes 120 of the condenser 100, and then exits into the discharge pipe 300 via a compartment R7 in the first header tank 140 defined by the baffle 161.

That is, the vertical section between the baffle 165 and the lowermost end of the condenser corresponds to the second sub-cooling section dm5.

Where the ratio $A_{dm4'}/A_{dm5}$ of the passage area $A_{dm4'}$ of the pre-sub-cooling section dm4' to the passage area $A_{dm5}$ of the second sub-cooling section dm5 is in a range of about 0.1 to 0.6, refrigerant sub-cooled in the first sub-cooling section dm5 can be further sub-cooled in the second sub-cooling section dm5.

In addition, the condenser of the invention satisfying $0.02 \leqq A_{dm4'}/A_{TOTAL} \leqq 0.15$, wherein $A_{dm4'}$ indicates the passage area of the pre-sub-cooling section dm4' and $A_{TOTAL}$ indicates the total heat transfer area of the condenser, can further follow a conditional expression of $0.20 \leqq A_{dm1}/A_{TOTAL} \leqq 0.60$, wherein $A_{dm1}$ indicates the passage area of the super heat cooling/condensing section dm1, in order to enhance the super heat cooling/condensing rate of refrigerant having high temperature and pressure.

In FIG. 5C, it can be seen that pressure drop is in inverse proportional to heat radiation where the ratio $A_{dm1}/A_{TOTAL}$ of the area of the super heat cooling/condensing section dm1 to the total heat transfer area of the condenser is in a range of about 20 to 60%.

That is, pressure drop declines inversely proportional to the ratio of the area $A_{dm1}$ of the heat-cooling/condensing section dm1 in respect to the total heat transfer area $A_{TOTAL}$, but heat radiation increase proportional to the same.

However, it is to be appreciated that pressure drop decreases reversed proportional to increase of the area ratio of the heat-cooling/condensing section dm1 and thus overall heat radiation can decrease resulting from area reduction of other sections.

In addition, the condenser of the invention satisfying $0.02 \leqq A_{dm4'}A_{TOTAL} \leqq 0.15$, wherein $A_{dm4'}$ indicates the passage area of the pre-sub-cooling section dm4' and $A_{TOTAL}$ indicates the total heat transfer area of the condenser, can further follow a conditional expression of $0.20 \leqq A_{dm5}/A_{dm1} \leqq 0.55$, wherein $A_{dm5}$ indicates the passage area of the second sub-cooling section dm5, in order to enhance the sub-cooling rate of refrigerant.

Describing in more detail, as shown in FIG. 5D, the condenser can obtain suitable value of heat radiation in a range of 20 to 55% which corresponds to an expression of $0.20 \leqq A_{dm5}/A_{dm1} \leqq 0.55$, wherein $A_{dm5}$ is the area of the second sub-cooling section dm5 and $A_{dm1}$ is the area of the super heat cooling/condensing section dm1.

That is, the above section shows a tendency that as the area $A_{dm5}$ of the second sub-cooling section dm5 increases in respect to the area $A_{dm1}$ of the super heat cooling/condensing section dm1, pressure drop slightly increases whereas heat radiation gradually increases up to the maximum value at about 40% and then gradually decreases.

Where the area $A_{dm1}$ of the super heat cooling/condensing section dm1 increases, a space for phase separation within the header increases whereas the area of a gas and liquid section relatively decreases and thus total heat radiation may decrease.

The above-described present invention can be proved more reliably by carefully considering how the filling quantity of refrigerant affects variation of sub-cooling temperature.

Figure 4:
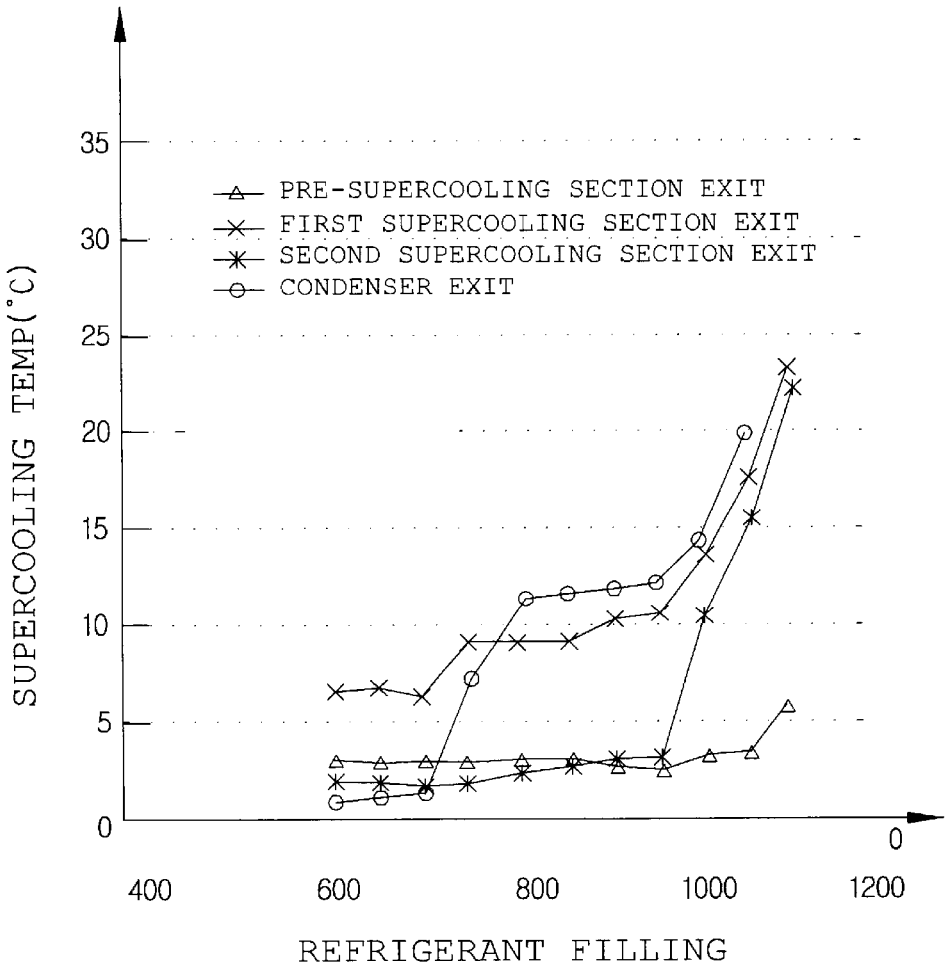
FIG. 4 is a graph of sub-cooling temperature variation according to refrigerant filling.

It can be seen in FIG. 4 that sub-cooling temperature generally increases proportion to the filling quantity of refrigerant, and in particular, is distinctly influenced even if a relatively small filling quantity of refrigerant is increased at a specific point where the filling quantity increases in the pre-sub-cooling section dm4'.

The above influence has an equal result also in an exit area of the condenser including the first sub-cooling section dm4 and the second sub-cooling section dm5.

That is, if sufficient sub-cooling can be obtained in the exit of the pre-sub-cooling section dm4', saturation temperature within the receiver section can be controlled.

Therefore, if an air flow is activated in the outlet side of the pre-sub-cooling section dm4' or separate cooling means are provided thereto to cool liquid refrigerant to enhance sub-cooling rate, it is possible to drop the temperature within the receiver section.

As set forth above, the gas-liquid separating condenser of the present invention can enhance the sub-cooling rate in the pre-sub-cooling section as well as in the total sections.

Moreover, the present invention can have suitable designs according to calculated conditional expressions of relative dimensional ratios of the sections in condensation of refrigerant to realize the optimum condensing efficiency regardless of the overall size of the gas-liquid separating condenser.

Although the preferred embodiments of the invention have been described and illustrated to explain the principle of the invention, the invention is not restricted to the construction and the operation which were illustrated and described hereinbefore.

Rather, those skilled in the art can readily make a number of alternatives and modification without departing from the principle and scope of the appended claims.

Therefore, those appropriate modifications, variations and equivalents should be considered to be within the scope of the present invention.

What is claimed is:

1. A multistage gas and liquid phase separation condenser comprising:

a super heat cooling/condensing section (dm1) for cooling gaseous refrigerant of high temperature and pressure, which is introduced into the section (dm1), to remove excessive heat therefrom and condense gaseous refrigerant;

a first condensing section (dm2) placed over the super heat cooling/condensing section (dm1) for re-condensing gaseous refrigerant;

a second condensing section (dm3) placed over the first condensing section (dm2) for re-condensing refrigerant to a liquid ratio higher than in the first condensing section (dm2), whereby refrigerant is introduced into a receiver section (400) after flowing through the second condensing section (dm3);

a first sub-cooling section (dm4) placed downstream of the super heat cooling/condensing section (dm1) for sub-cooling refrigerant more than in the super heat cooling/condensing section (dm1), whereby refrigerant is introduced into the receiver section (400) after flowing though the first sub-cooling section (dm4) to join liquid refrigerant from the second condensing section (dm3); and a second sub-cooling section (dm5) placed downstream of the first sub-cooling section (dm4) for sub-cooling liquid refrigerant joined from the second condensing section (dm3) and the first sub-cooling section (dm4) and for discharging sub-cooled liquid refrigerant therefrom, wherein the sections (dm1, dm2, dm3, dm4 and dm5) are divided from one another; and the sections (dm1, dm2, dm3, dm4 and dm5) satisfy an expression of $A_{dm1}>A_{dm2}\geqq A_{dm3}$ and $A_{dm4}\leqq A_{dm5}$, wherein $A_{dm1}$ is an area of the super heat cooling/condensing section (dm1), $A_{dm2}$ is an area of the first condensing section (dm2), $A_{dm3}$ is an area of the second condensing section (dm3), $A_{dm4}$ is an area of the first sub-cooling section (dm4), and $A_{dm5}$ is an area of the second sub-cooling section (dm5), a pre-sub-cooling section (dm4') in the first sub-cooling section (dm4), placed between the super heat cooling/condensing section (dm1) and the second sub-cooling section (dm5), and wherein the pre-sub-cooling section (dm4') satisfies an expression of $0.02\leqq A_{dm4'}/A_{TOTAL}\leqq 0.15$, wherein $A_{dm4}$ indicates a passage area of the pre-sub-cooling section (dm4') for sub-cooling liquid refrigerant, and $A_{TOTAL}$ indicates a total heat transfer area of the condenser.

2. The multistage gas and liquid phase separation condenser as set forth in claim 1, wherein the pre-sub-cooling section (dm4') and the second sub-cooling section dm5 satisfy an expression of $0.1\leqq A_{dm4'}/A_{dm5}\leqq 0.6$, wherein $A_{dm4'}$ indicates a passage area of the pre-sub-cooling section (dm4'), and $A_{dm5}$ indicates a passage area of the second sub-cooling section dm5.

3. A multistage gas and liquid phase separation condenser composing:

a super heat cooling/condensing section (dm1) for cooling gaseous refrigerant of high temperature and pressure, which is introduced into the section (dm1), to remove excessive heat therefrom and condense gaseous refrigerant;

a first condensing section (dm2) placed over the super heat cooling/condensing section (dm1) for re-condensing gaseous refrigerant;

a second condensing section (dm3) placed over the first condensing section (dm2) for re-condensing refrigerant to a liquid ratio higher than in the first condensing section (dm2), whereby refrigerant is introduced into a receiver section (400) after flowing through the second condensing section (dm3);

a first sub-cooling section (dm4) placed downstream of the super heat cooling/condensing section (dm1) for sub-cooling refrigerant more than in the super heat cooling/condensing section (dm1), whereby refrigerant is introduced into the receiver section (400) after flowing through the first sub-cooling section (dm4) to join liquid refrigerant from the second condensing section (dm3); and a second sub-cooling section (dm5) placed downstream of the first sub-cooling section (dm4) for sub-cooling liquid refrigerant joined from the second condensing section (dm3 and the first sub-cooling section (dm4) and for discharging sub-cooled liquid refrigerant therefrom, wherein the sections (dm1, dm2, dm3, dm4 and dm5) are divided from one another; and the sections (dm1, dm2, dm3, dm4 and dm5) satisfy an expression of $A_{dm1}>A_{dm2}\geqq A_{dm3}$ and $A_{dm4}\leqq A_{dm5}$, wherein $A_{dm1}$, is an area of the super heat cooling/condensing section (dm1), $A_{dm2}$ is an area of the first condensing section (dm2), $A_{dm3}$ is an area of the second condensing section (dm3), $A_{dm4}$ is an area of the first sub-cooling section (dm4), and $A_{dm5}$ is an area of the second sub-cooling section (dm5), and a pre-sub-cooling section (dm4') in the first sub-cooling section (dm4), placed between the super heat cooling/condensing section (dm1) and the second sub-cooling section (dm5), wherein the pie-sub-cooling section (dm4') and the second sub-cooling section dm5 satisfy an expression of $0.1 \leqq A_{dm4'}/A_{dm5} \leqq 0.6$, wherein $A_{dm4'}$ indicates a passage area of the pre-sub-cooling section (dm4'), and $A_{dm5}$ indicates a passage area of the second sub-cooling section dm5.

4. A multistage gas and liquid phase separation condenser comprising:

a super heat cooling/condensing section (dm1) for cooling gaseous refrigerant of high temperature and pressure, which is introduced into the section (dm1), to remove excessive heat therefrom and condense gaseous refrigerant;

a first condensing section (dm2) placed over the super heat cooling/condensing section (dm1) for re-condensing gaseous refrigerant;

a second condensing section (dm3) placed over the first condensing section (dm2) for re-condensing refrigerant to a liquid ratio higher than in the first condensing section (dm2), whereby refrigerant is introduced into a receiver section (400) after flowing through the second condensing section (dm3);

a first sub-cooling section (dm4) placed downstream of the super heat cooling/condensing section (dm1) for sub-cooling refrigerant more than in the super heat cooling/condensing section (dm1), whereby refrigerant is introduced into the receiver section (400) after flowing through the first sub-cooling section (dm4) to join liquid refrigerant from the second condensing section (dm3); and a second sub-cooling section (dm5) placed downstream of the first sub-cooling section (dm4) for sub-cooling liquid refrigerant joined from the second condensing section (dm3) and the first sub-cooling section (dm4) and for discharging sub-cooled liquid refrigerant therefrom, wherein the sections (dm1, dm2, dm3, dm4 and dm5) are divided from one another; and the sections (dm1, dm2, dm3, dm4 and dm5) satisfy an expression of $A_{dm1} > A_{dm2} \geqq A_{dm3}$ and $A_{dm4} \leqq A_{dm5}$, wherein $A_{dm1}$ is an area of the super heat cooling/condensing section (dm1), $A_{dm2}$ is an area of the first condensing section (dm2), $A_{dm3}$ is an area of the second condensing section (dm3), $A_{dm4}$ is an area of the first sub-cooling section (dm4), and $A_{dm5}$ is an area of the second sub-cooling section (dm5), and a pre-sub-cooling section (dm4') in the first sub-cooling section (dm4, placed between the super heat cooling/condensing section (dm1) and the second sub-cooling section (dm5), wherein the super heat cooling/condensing section (dm1) and the first condensing section (dm2) satisfy an expression of $0.20 \leqq (A_{dm2}/A_{dm1}) \leqq 0.65$, wherein $A_{dm1}$ is an area of the super heat cooling/condensing section (dm1), and $A_{dm2}$ is an area of the first condensing section (dm2).

5. A multistage gas and liquid phase separation condenser comprising:

a super heat cooling/condensing section (dm1) for cooling gaseous refrigerant of high temperature and pressure, which is introduced into the section (dm1), to remove excessive heat therefrom and condense gaseous refrigerant;

a first condensing section (dm2) placed over the super heat cooling/condensing section (dm1) for re-condensing gaseous refrigerant;

a second condensing section (dm3) placed over the first condensing section (dm2) for re-condensing refrigerant to a liquid ratio higher than in the first condensing section (dm2), whereby refrigerant is introduced into a receiver section (400) after flowing through the second condensing section (dm3);

a first sub-cooling section (dm4) placed downstream of the super heat cooling/condensing section (dm1) for sub-cooling refrigerant more than in the super heat cooling/condensing section (dm1), whereby refrigerant is introduced into the receiver section (400) after flowing through the first sub-cooling section (dm4) to join liquid refrigerant from the second condensing section (dm3); and a second sub-cooling section (dm5) placed downstream of the first sub-cooling section (dm4) for sub-cooling liquid refrigerant joined from the second condensing section (dm3) and the first sub-cooling section (dm4) and for discharging sub-cooled liquid refrigerant therefrom, wherein the sections (dm1, dm2, dm3, dm4 and dm5) are divided from one another; and the sections (dm1, dm2, dm3, dm4 and dm5) satisfy an expression of $A_{dm1} > A_{dm2} \geqq A_{dm3}$ and $A_{dm4} \leqq A_{dm5}$, wherein $A_{dm1}$ is an area of the super heat cooling/condensing section (dm1), $A_{dm2}$ is an area of the first condensing section (dm2), $A_{dm3}$ is an area of the second condensing section (dm3), $A_{dm4}$ is an area of the first sub-cooling section (dm4), and $A_{dm5}$ is an area of the second sub-cooling section (dm5), and a pre-sub-cooling section (dm4') in the first sub-cooling section (dm4), placed between the super heat cooling/condensing section (dm1) and the second sub-cooling section (dm5), wherein the super heat cooling/condensing section (dm1) and the pre-sub-cooling section (dm4') satisfy an expression of $0.04 \leqq (A_{dm4'}/A_{dm1}) \leqq 0.22$ wherein $A_{dm1}$ is an area of the super heat cooling/condensing section (dm1), and $A_{dm4'}$ is an area of the pre-sub-cooling section (dm4').

6. A multistage gas and liquid phase separation condenser comprising:

a super heat cooling/condensing section (dm1) for cooling gaseous refrigerant of high temperature and pressure, which is introduced into the section (dm1), to remove excessive heat therefrom and condense gaseous refrigerant;

a first condensing section (dm2) placed over the super heat cooling/condensing section (dm1) for re-condensing gaseous refrigerant;

a second condensing section (dm3) placed over the first condensing section (dm2) for re-condensing refrigerant to a liquid ratio higher than in the first condensing section (dm2), whereby refrigerant is introduced into a receiver section (400) after flowing through the second condensing section (dm3);

a first sub-cooling section (dm4) placed downstream of the super heat cooling/condensing section (dm1) for sub-cooling refrigerant more than in the super heat cooling/condensing section (dm1), whereby refrigerant is introduced into the receiver section (400) after flowing through the first sub-cooling section (dm4) to join liquid refrigerant from the second condensing section (dm3); and a second sub-cooling section (dm5) placed downstream of the first sub-cooling section (dm4) for sub-cooling liquid refrigerant joined from the second condensing section (dm3) and the first sub-cooling section (dm4) and for discharging sub-cooled liquid refrigerant therefrom, wherein the sections (dm1, dm2, dm3, dm4 and dm5) are divided from one another; and the sections (dm1, dm2, dm3, dm4 and dm5) satisfy an expression of $A_{dm1}>A_{dm2}\geqq A_{dm3}$ and $A_{dm4}\leqq A_{dm5}$, wherein $A_{dm1}$ is an area of the super heat cooling/condensing section (dm1), $A_{dm2}$ is an area of the first condensing section (dm2), $A_{dm3}$ is an area of the second condensing section (dm3), $A_{dm4}$ is an area of the first sub-cooling section (dm4), and $A_{dm5}$ is an area of the second sub-cooling section (dm5), and a pre-sub-cooling section (dm4') in the first sub-cooling section (dm4), placed between the super heat cooling/condensing section (dm1) and the second sub-cooling section (dm5), wherein the super heat cooling/condensing section (dm1) satisfies an expression of $0.20\leqq A_{dm1}/A_{TOTAL}\leqq 0.60$, wherein $A_{dm1}$ is an area of the super heat cooling/condensing section (dm1), and $A_{TOTAL}$ indicates a total heat transfer area of the condenser.

7. A multistage gas and liquid phase separation condenser comprising:

a super heat cooling/condensing section (dm1) for cooling gaseous refrigerant of high temperature and pressure, which is introduced into the section (dm1), to remove excessive heat therefrom and condense gaseous refrigerant;

a first condensing section (dm2) placed over the super heat cooling/condensing section (dm1) for re-condensing gaseous refrigerant;

a second condensing section (dm3) placed over the first condensing section (dm2) for re-condensing refrigerant to a liquid ratio higher than in the first condensing section (dm2), whereby refrigerant is introduced into a receiver section (400) after flowing through the second condensing section (dm3);

a first sub-cooling section (dm4) placed downstream of the super heat cooling/condensing section (dm1) for sub-cooling refrigerant more than in the super heat cooling/condensing section (dm1), whereby refrigerant is introduced into the receiver section (400) after flowing through the first sub-cooling section (dm4) to join liquid refrigerant from the second condensing section (dm3); and a second sub-cooling section (dm5) placed downstream of the first sub-cooling section (dm4) for sub-cooling liquid refrigerant joined from the second condensing section (dm3) and the first sub-cooling section (dm4) and for discharging sub-cooled liquid refrigerant therefrom, wherein the sections (dm1, dm2, dm3, dm4 and dm5) are divided from one another; and the sections (dm1, dm2, dm3, dm4 and dm5) satisfy an expression of $A_{dm1}>A_{dm2}\geqq A_{dm3}$ and $A_{dm4}\leqq A_{dm5}$, wherein $A_{dm1}$ is an area of the super heat cooling/condensing section (dm1), $A_{dm2}$ is an area of the first condensing section (dm2), $A_{dm3}$ is an area of the second condensing section (dm3), $A_{dm4}$ is an area of the first sub-cooling section (dm4), and $A_{dm5}$ is an area of the second sub-cooling section (dm5), and a pre-sub-cooling section (dm4') in the first sub-cooling section (dm4), placed between the super heat cooling/condensing section (dm1) and the second sub-cooling section (dm5), wherein the super heat cooling/condensing section (dm1) and the second sub-cooling section (dm5) satisfy an expression of $0.20\leqq(A_{dm5}/A_{dm1})\leqq 0.55$, wherein $A_{dm1}$ is an area of the super heat cooling/condensing section (dm1), and $A_{dm5}$ is an area of the second sub-cooling section (dm5).

8. A multistage gas and liquid phase separation condenser comprising:

a super heat cooling/condensing section (dm1) for cooling gaseous refrigerant of high temperature and pressure, which is introduced into the section (dm1), to remove excessive heat therefrom and condense gaseous refrigerant;

a first condensing section (dm2) placed over the super heat cooling/condensing section (dm1) for re-condensing gaseous refrigerant;

a second condensing section (dm3) placed over the first condensing section (dm2) for re-condensing refrigerant to a liquid ratio higher than in the first condensing section (dm2), whereby refrigerant is introduced into a receiver section (400) after flowing through the second condensing section (dm3);

a first sub-cooling section (dm4) placed downstream of the super heat cooling/condensing section (dm1) for sub-cooling refrigerant more than in the super heat cooling/condensing section (dm1), whereby refrigerant is introduced into the receiver section (400) after flowing through the first sub-cooling section (dm4) to join liquid refrigerant from the second condensing section (dm3); and a second sub-cooling section (dm5) placed downstream of the first sub-cooling section (dm4) for sub-cooling liquid refrigerant joined from the second condensing section (dm3) and the first sub-cooling section (dm4) and for discharging sub-cooled liquid refrigerant therefrom, wherein the sections (dm1, dm2, dm3, dm4 and dm5) are divided from one another; and the sections (dm1, dm2, dm3, dm4 and dm5) satisfy an expression of $A_{dm1}>A_{dm2}\geqq A_{dm3}$ and $A_{dm4}\leqq A_{dm5}$, wherein $A_{dm1}$ is an area of the super heat cooling/condensing section (dm1), $A_{dm2}$ is an area of the first condensing section (dm2), $A_{dm3}$ is an area of the second condensing section (dm3), $A_{dm4}$ is an area of the first sub-cooling section (dm4), and $A_{dm5}$ is an area of the second sub-cooling section (dm5), wherein the super heat cooling/condensing section (dm1) and the first condensing section (dm2) satisfy an expression of $0.20\leqq(A_{dm2}/A_{dm1})\leqq 0.65$, wherein $A_{dm1}$ is an area of the super heat cooling/condensing section (dm1), and $A_{dm2}$ is an area of the first condensing section (dm2).

9. A multistage gas and liquid phase separation condenser comprising:

a super heat cooling/condensing section (dm1) for cooling gaseous refrigerant of high temperature and pressure, which is introduced into the section (dm1), to remove excessive heat therefrom and condense gaseous refrigerant;

a first condensing section (dm2) placed over the super heat cooling/condensing section (dm1) for re-condensing gaseous refrigerant;

a second condensing section (dm3) placed over the first condensing section (dm2) for re-condensing refrigerant to a liquid ratio higher than in the first condensing section (dm2), whereby refrigerant is introduced into a receiver section (400) after flowing through the second condensing section (dm3);

a first sub-cooling section (dm4) placed downstream of the super heat cooling/condensing section (dm1) for sub-cooling refrigerant more than in the super heat cooling/condensing section (dm1), whereby refrigerant is introduced into the receiver section (400) after flowing through the first sub-cooling section (dm4) to join liquid refrigerant from the second condensing section (dm3); and a second sub-cooling section (dm5) placed downstream of the first sub-cooling section (dm4) for sub-cooling liquid refrigerant joined from the second condensing section (dm3) and the first sub-cooling section (dm4) and for discharging sub-cooled liquid refrigerant therefrom, wherein the sections (dm1, dm2, dm3, dm4 and dm5) are divided from one another; and the sections (dm1, dm2, dm3, dm4 and dm5) satisfy an expression of $A_{dm1}>A_{dm2}\geqq A_{dm3}$ and $A_{dm4}\leqq A_{dm5}$, wherein $A_{dm1}$ is an area of the super heat cooling/condensing section (dm1), $A_{dm2}$ is an area of the first condensing section (dm2), $A_{dm3}$ is an area of the second condensing section (dm3), $A_{dm4}$ is an area of the first sub-cooling section (dm4), and $A_{dm5}$ is an area of the second sub-cooling section (dm5), wherein the super heat cooling/condensing section (dm1) satisfies an expression of $0.20\leqq A_{dm1}/A_{TOTAL})\leqq 0.60$, wherein $A_{dm1}$ is an area of the super heat cooling/condensing section (dm1), and $A_{TOTAL}$ indicates a total heat transfer area of the condenser.

10. A multistage gas and liquid phase separation condenser comprising:

a super heat cooling/condensing section (dm1) for cooling gaseous refrigerant of high temperature and pressure, which is introduced into the section (dm1), to remove excessive heat therefrom and condense gaseous refrigerant;

a first condensing section (dm2) placed over the super heat cooling/condensing section (dm1) for re-condensing gaseous refrigerant;

a second condensing section (dm3) placed over the first condensing section (dm2) for re-condensing refrigerant to a liquid ratio higher than in the first condensing section (dm2), whereby refrigerant is introduced into a receiver section (400) after flowing through the second condensing section (dm3);

a first sub-cooling section (dm4) placed downstream of the super heat cooling/condensing section (dm1) for sub-cooling refrigerant more than in the super heat cooling/condensing section (dm1), whereby refrigerant is introduced into the receiver section (400) after flowing through the first sub-cooling section (dm4) to join liquid refrigerant from the second condensing section (dm3); and a second sub-cooling section (dm5) placed downstream of the first sub-cooling section (dm4) for sub-cooling liquid refrigerant joined from the second condensing section (dm3) and the first sub-cooling section (dm4) and for discharging sub-cooled liquid refrigerant therefrom, wherein the sections (dm1, dm2, dm3, dm4 and dm5) are divided from one another; and the sections (dm1, dm2, dm3, dm4 and dm5) satisfy an expression of $A_{dm1}>A_{dm2}\geqq A_{dm3}$ and $A_{dm4}\leqq A_{dm5}$, wherein $A_{dm1}$ is an area of the super heat cooling/condensing section (dm1), $A_{dm2}$ is an area of the first condensing section (dm2), $A_{dm3}$ is an area of the second condensing section (dm3), $A_{dm4}$ is an area of the first sub-cooling section (dm4), and $A_{dm5}$ is an area of the second sub-cooling section (dm5), wherein the super heat cooling/condensing section (dm1) and the second sub-cooling section (dm5) satisfy an expression of $0.20\leqq(A_{dm5}/A_{dm1})\leqq 0.55$, wherein $A_{dm1}$ is an area of the super cooling/condensing section (dm1), and $A_{dm5}$ is an area of the second sub-cooling section (dm5).

* * * * *